US005634670A

United States Patent [19]

Orensteen et al.

[11] Patent Number: 5,634,670

[45] Date of Patent: Jun. 3, 1997

[54] VALIDATION STICKER MOUNTING SYSTEM AND COMPONENTS FOR USE THEREIN

[75] Inventors: Bruce D. Orensteen, St. Paul; Joseph R. Zwack, Roseville; David L. Meyer, Lake Elmo, all of Minn.

[73] Assignee: Minnesota Mining and Manufacturing Company, St. Paul, Minn.

[21] Appl. No.: 354,278

[22] Filed: Dec. 12, 1994

[51] Int. Cl.[6] ..... B42D 15/00

[52] U.S. Cl. ..... 283/81; 283/101; 283/108; 40/200; 40/630; 40/910; 428/40.1

[58] Field of Search ..... 283/81, 101, 108; 40/661, 910, 200, 206, 209, 625, 626, 630; 428/40.1

[56] References Cited

U.S. PATENT DOCUMENTS

| | | | |
|---|---|---|---|
| D. 308,849 | 6/1990 | Short et al. | D12/193 |
| 3,500,364 | 3/1970 | David et al. | 283/81 X |
| 3,641,804 | 2/1972 | Oudenhoven | 72/409 |
| 4,531,313 | 7/1985 | Fast | 40/19.5 |
| 4,547,001 | 10/1985 | Stitt | 283/81 |
| 4,903,422 | 2/1990 | Varga | 40/201 |
| 5,013,088 | 5/1991 | Marin | 283/81 |
| 5,094,357 | 3/1992 | McKinney | 220/214 |
| 5,149,571 | 9/1992 | Croell | 428/40 |
| 5,210,966 | 5/1993 | Fuehrer | 40/1.5 |

FOREIGN PATENT DOCUMENTS

| | | | |
|---|---|---|---|
| 2831853 | of 0000 | Germany . | |
| 73698 | 6/1977 | Japan | 283/81 |
| 608203 | 5/1978 | U.S.S.R. | 283/81 |
| 2 194 932 | 3/1988 | United Kingdom . | |

OTHER PUBLICATIONS

Eastman Kodak Research Disclosure Document, No. 172, Item 17255. Aug. 1978.

*Primary Examiner*—Frances Han

*Attorney, Agent, or Firm*—Gary L. Griswold; Walter N. Kirn; Robert H. Jordan

[57] ABSTRACT

Validation sticker mounting system and components for such a system. The components include stickers and substrates adapted in a coordinated manner. The substrates have a surface portion having a recessed segment into which the sticker is to be applied. The stickers, which are adapted for presentation of readable information and bonding to the substrate, have one or more security openings through which a post on the surface of the substrate extends.

18 Claims, 3 Drawing Sheets

VALIDATION STICKER MOUNTING SYSTEM AND COMPONENTS FOR USE THEREIN

FIELD OF INVENTION

The present invention relates to a validation sticker mounting system and validation stickers and substrates adapted for use therein.

BACKGROUND

For many years, validation stickers have been applied to motor vehicles to indicate that applicable taxes have been paid and/or required registrations and inspections have been completed. In a common application, small stickers (typically on the order of about 2.5 by 3.8 centimeters or so (1 by 1.5 inches) and sometimes colloquially referred to as "tabs") are applied to a designated location on the vehicle's license plate(s) to indicate that annual licensing taxes and registration fees have been paid. Other illustrative examples include application of stickers as proof of satisfactory vehicle safety inspections, satisfactory vehicle emission control inspections, and insurance coverage. In many instances, stickers are stacked, i.e., each year the new sticker is applied directly over the sticker from the previous year.

One effect of increased tax rates, stricter insurance requirements, more rigorous environmental and other regulatory requirements, etc., is that possession of validation stickers may represent substantial economic value. As a result, validation stickers have increasingly become targets for theft. In order to avoid paying applicable taxes, or to obtain proof of inspection for vehicles that could not meet applicable requirements, etc., thieves may remove stickers from the license plates of vehicles where the stickers have been legitimately applied and seek to illegally reapply them to the license plates of other vehicles. Removal of stickers is typically easier when the sticker is applied to a portion of a larger flat surface and when the sticker is of a highly cohesive, strong construction. Stickers which are stacked may be particularly susceptible to theft because the stack provides a number of interfaces where delamination, or layers in which cohesive failure, may be induced, e.g., with a razor blade, utility knife, scalpel, etc. Also, underlying stacked stickers tend to reinforce the topmost current sticker, thereby making it easier to remove and handle without apparent damage.

In order to avoid stacking of stickers, states or provinces may issue stickers with less aggressive adhesive and higher tear strength to facilitate their removal at the time the following year's sticker is applied. Such increased ease of removability, however, also facilitates unauthorized removal of stickers for improper application to other vehicles. Another alternative to stacking stickers is to provide a series of designated locations on a license plate for stickers to be applied, typically in prescribed sequence. Many states or provinces do not wish to use license plates with such multiple locations, however, because the resultant license plates become unsightly, it is harder to readily determine if current stickers are presented, there is greater probability of incorrect application of a sticker, and available space on the face of the license plate may be desired for other features, e.g., state mottos, vehicle classification information, aesthetic presentation, etc.

To date, certain steps have been taken to inhibit unauthorized removal and theft of intact validation stickers, including use of very strong adhesives, stickers with low tear strength, and perforated stickers. Despite these steps, however, additional and improved alternatives for inhibiting removal of stickers are desired.

SUMMARY OF INVENTION

The present invention provides a mounting system for validation stickers that inhibits unauthorized removal and theft of stickers. It also provides components for the novel mounting system including validation stickers and substrates designed for use therein.

In brief summary, the system of the invention comprises validation stickers and substrates (e.g., license plates) having coordinated design that are assembled in a coordinated manner as described herein. Substrates used in the system comprise a substantially planar surface portion, one segment of which is recessed for insertion of a validation sticker. The recessed segment has one or more posts that correspond(s) to security opening(s) of the validation sticker to be applied. Validation stickers used in the system each comprise a sheet having first and second major surfaces, the first major surface or front of the sticker being adapted for presentation of readable information and the second major surface being adapted for bonding the sticker to the substrate. The sticker has one or more security openings that correspond to one or more posts in the substrate. Once the sticker is bonded to the substrate, one or more posts extends through one or more security openings.

The present invention makes removal of validation stickers more difficult, particularly removal in sufficiently intact condition to permit reuse of the stickers, thereby inhibiting a major motive for tampering. Because the sticker is situated within a recess in the surface of the substrate, ready access to the edges of the sticker is hindered, thereby inhibiting removal attempts. Also, each post of the substrate which extends through a security opening of the sticker presents an obstacle for a razor or other tool used while attempting to remove the sticker, thereby further hampering removal efforts. Despite the enhanced resistance to unauthorized removal, however, the stickers are readily applied to the substrate and the system is thus suitable for use by the general populace, e.g., for use with general issue automobile registration stickers.

BRIEF DESCRIPTION OF DRAWING

The invention will be further explained with reference to the drawing, wherein.

These figures, which are idealized, are not to scale and are intended to be merely illustrative and non-limiting.

DETAILED DESCRIPTION OF ILLUSTRATIVE EMBODIMENTS

Figure 1:
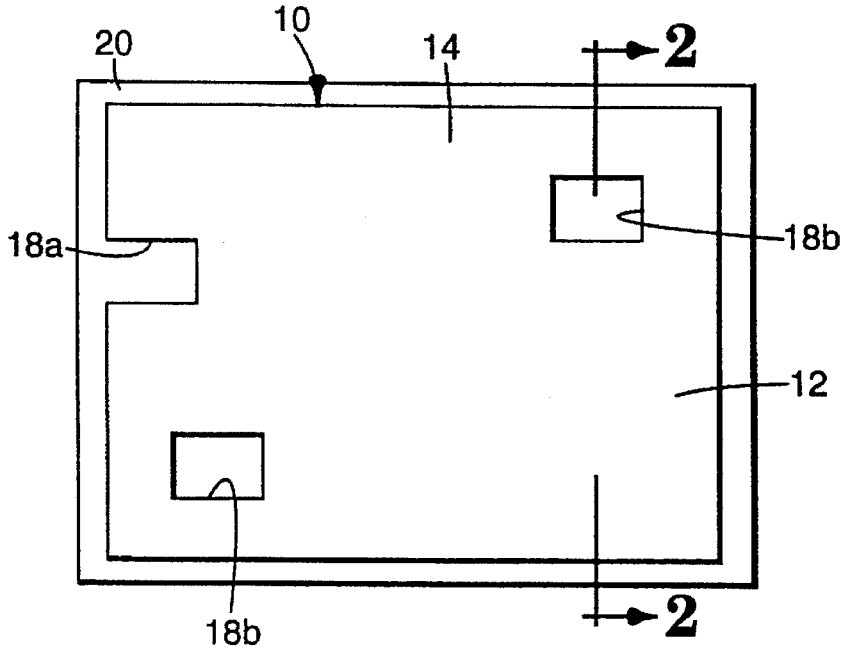
FIG. 1 is a plan view of the front of one embodiment of a validation sticker of the invention.
Figure 2:
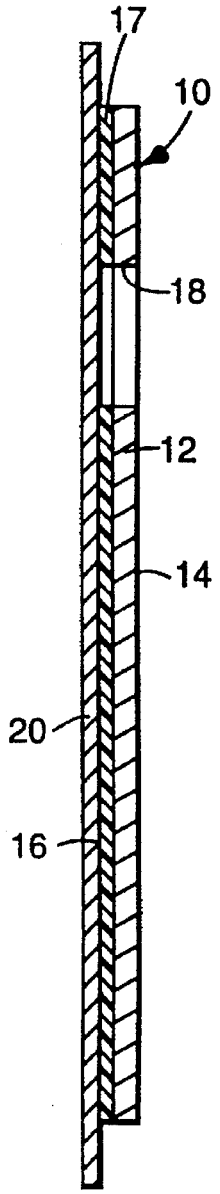
FIG. 2 is a cross-sectional view of the sticker of FIG. 1 on a temporary carrier.

An illustrative validation sticker 10 used in the invention is shown in FIGS. 1 and 2. Validation sticker 10 comprises sheet 12 having first major surface 14 and second major surface 16. In the embodiment shown, second surface 16 has adhesive layer 17. Sheet 12 has one or more security openings 18*a*, 18*b*. In many instances, sticker 10 will be on temporary carrier 20 prior to use. Carrier 20, to which sticker 10 is releasably bonded, can be used to facilitate fabrication and handling of the sticker. If desired, a carrier (not shown) releasably bonded to first major surface 14 may also be used alone or in combination with a carrier on second major surface 16. The support such carriers can provide during fabrication, handling, issuance, and application of stickers can enable the use of stickers having very low tear strength, thereby enhancing their resistance to removal and unauthorized reapplication.

First major surface 14 is adapted for presentation of readable information as desired. In some instances it may be a surface to which desired information is applied, e.g., by printing, and as such may have been prepared or primed to facilitate application of the desired information via the desired manner. In some instances, desired information will already have been formed thereon. In many embodiments, information will be readable to the unaided eye and may be in the form of selected alphanumeric characters or other symbols, e.g., bar codes, emblems, etc., in desired colors. If desired, the information may be readable by other means, e.g., machine readable infrared images. A variety of suitable means for forming desired images on major surface 14 will be readily apparent to those with ordinary skill in the art. To enhance the visibility and/or legibility of the sticker, surface 14 may be retroreflective at least in part.

Second major surface 16 is adapted for bonding sticker 10 to a substrate (not shown). In some embodiments as shown in FIG. 2, surface 16 may be a layer of adhesive 17. Selection of suitable adhesives will be dependent in part upon the characteristics of the other portions of sheet 10, the characteristics of the substrate to which sticker 10 is to be applied, the conditions and manner under which the sticker is to be applied, and the conditions to which the substrate with applied sticker are to be subjected during use. Illustrative examples of adhesives useful for some embodiments of the invention include pressure-sensitive adhesives, hot melt adhesives, activated adhesives (e.g., via actinic radiation, chemical initiators, etc.), etc. Suitable adhesives for specific embodiments will be readily selected by those with ordinary skill in the art.

In other embodiments, sticker 10 is bonded to the substrate with an adhesive that is first applied to the surface of the substrate. In such instances, surface 16 may be inherently suitable for use with the intended adhesive or may be treated with suitable priming treatments such as corona or plasma exposure or application of priming coatings to improve its suitability for use with the intended adhesive. Selection of suitable treatments and adhesives will be readily made by those with ordinary skill in the art.

Typically, whether the adhesive layer is part of the sticker or is first applied to the substrate, the strength of the bond between the adhesive and substrate and strength of the bond between the adhesive and overlying components of the sticker, both preferably exceed the cohesive strength of the sticker. Such a balance of bond and cohesive strengths will inhibit unauthorized removal of the sticker.

Stickers of the invention and the corresponding recesses in the substrate into which they are to be applied may be of any desired shape, e.g., rectangular (as shown in the Figures), triangular, circular, round, oval, block T, etc. The sticker and corresponding recess need not have similar shape, but may have a similar shape if desired. Preferably, the sticker has a similar shape to but is slightly smaller than the corresponding recess such that after application to the substrate, the sticker covers substantially all of the floor of the recess substantially without covering the perimeter sides thereof, rendering the edge of the sticker more inaccessible. In common embodiments, the stickers are generally rectangular in shape as shown in FIGS. 1 and 3.

As used herein, by "security opening" it is meant that a straight line drawn through any portion of the opening will intersect the sheet on two sides of the opening. Opening 18*a* in FIG. 1 is considered to be a security opening herein referred to as a "perimeter security opening" because the opening crosses the perimeter of the sticker. In the case of such openings, the coordinating post in the substrate may be connected with the perimeter of the recess in the substrate. Preferably, stickers of the invention have at least one security opening that is completely surrounded by the sheet, such as interior security openings 18*b* in FIG. 1. Typically stickers with interior security openings in accordance with the invention are more difficult to remove intact than are stickers with only perimeter security openings.

Figure 3:
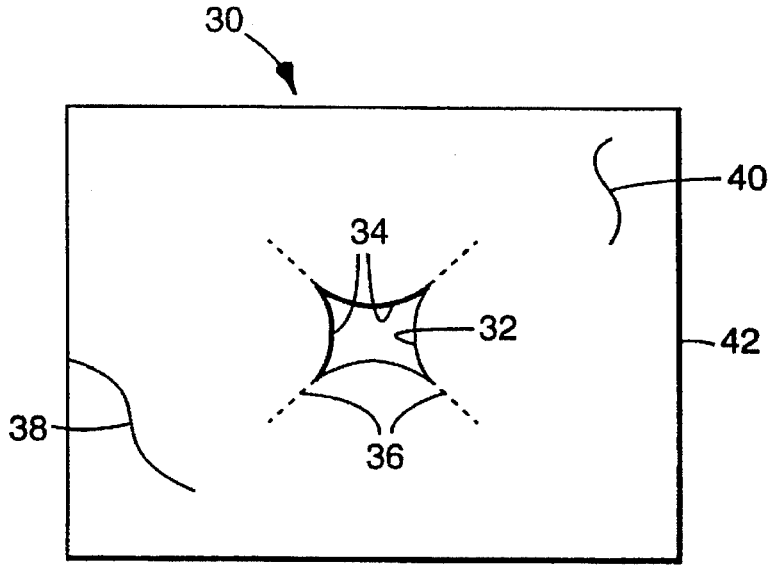
FIG. 3 is a plan view of the front of another embodiment of a validation sticker of the invention.
Figure 4:
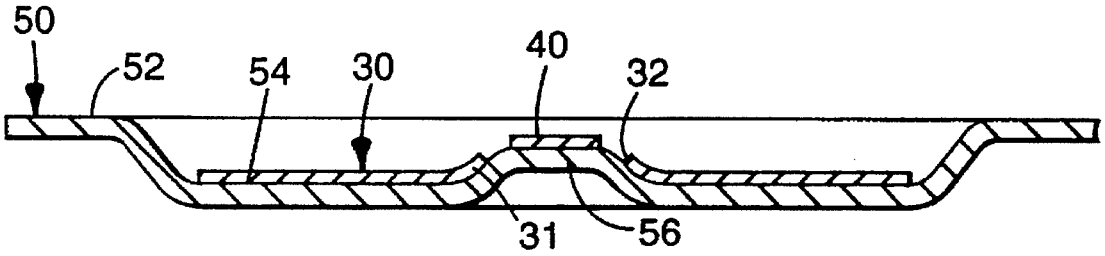
FIG. 4 is a cross-sectional view of a portion of a license plate to which the sticker of FIG. 3 has been applied in accordance with an embodiment of the invention.

Referring to FIG. 3, in preferred embodiments validation sticker 30 typically has at least one security opening 32 that has inwardly protruding borders 34. By "inwardly protruding", it is meant that the border of the opening is curved and/or protrudes or extends into the opening. In contrast, security openings 18 *a*, 18*b* in sticker 10 shown in FIG. 1 have straight borders such that the openings are of generally rectangular shape. Inwardly protruding borders can be used to increase the area of the major surface of the sticker to increase the available area for information. Also, by adhering portions of the sticker to portions of the sides or shoulders of the post, they increase the difficulty in removing the sticker from the substrate. For instance, as shown in FIG. 4, inwardly protruding border 34 covers a portion of the slope of post 56 of plate 50. It will be understood that stickers of the invention may have security openings having outwardly protruding borders if desired. In some embodiments the security openings and posts are of the same dimension and shape and that shape has an interlocking or meshing pattern. For instance, the sticker shown in FIG. 3 could be applied to a substrate with post having a fluted shape, i.e., curved sides between pointed corners, to yield a difficult to remove validation sticker.

Validation stickers are preferably such that they tear and shred into small pieces when removed after being applied to a desired substrate. In many embodiments, the stickers have low tear strength, especially relative to the strength of the bond to the substrate. In some embodiments, one or more slits may be formed in the sticker. As used herein, slits may be fine cuts that extend through the entirety of the sticker (possibly including the underlying adhesive layer) or the slits may extend through only a portion of the thickness of the sticker (e.g., through a portion of sheet 12). The latter embodiment may be used to increase the structural integrity of the sticker to facilitate preapplication handling, while weakening the sticker enough to provide desired tamper resistance. If desired, each slit may be a long continuous cut or a series of short cuts interrupted by small tie segments, i.e., the sticker may be perforated.

As shown in FIG. 3, the border of at least one security opening 32 may be intersected by one or more slits 36. If desired, sticker 30 may optionally have at least one slit 38 that intersects an exterior edge 42 of sticker 30 but that does not intersect a security opening. Also, sticker 30 may optionally have at least one slit 40 which does not intersect an exterior edge 42 of sticker 30.

In some embodiments, the security opening of the sticker will be left empty such that the post of the substrate can be extended therethrough and is visible to one examining the front of the substrate after application of stickers. Typically, manufacture of the sticker includes, among other steps, cutting (e.g., by stamping, kiss cutting, etc.) and removing the excised portions from a continuous film or sheet material to provide the security openings used herein. In some instances, however, a security opening may be cut in the initial sheet, but a substantial portion of the sheet material left therein so as to form an island. In such instances, the security opening preferably corresponds to a post as described herein, but the island may be adhered to the post upon application of the sticker to the substrate. In these embodiments, the island is available for information display, permitting greater flexibility with regard to how information may be displayed on the sticker.

A typical substrate with sticker applied in accordance with the invention is shown in FIG. 4 wherein license plate 50 comprises substantially planar surface portion 52 with segment 54 being recessed for insertion of validation sticker 30. Segment 54 has post 56 corresponding to security opening 32 of sticker 30. Optional island 40 is shown on post 56. Sticker 30 covers substantially all of the floor of recess 54 substantially without covering the perimeter sides thereof, thereby rendering the edge of sticker 30 more inaccessible and tamper proof.

In some embodiments, security opening 32 is made slightly smaller than the size of post 56 such that after sticker 30 is applied, the portions 31 of sticker 30 near post 56 are preferably curved slightly with an inwardly protruding border such as shown in FIG. 3.

Preferably, the recess in the substrate substantially conforms to the perimeter of the sticker. The more closely the recess conforms to the perimeter of the sticker, the more effectively the substrate shields the perimeter of the sticker from tampering.

The recess in the substrate is preferably at least as deep as the thickness of the sticker to be applied therein and is more preferably several times as deep as the thickness of the sticker. Deeper recesses provide better protection against removal of the sticker and can accommodate stacking of several stickers while achieving the advantages of the invention. For instance, license plates are sometimes used for as long as six or more years before being replaced with newly issued plates and validation stickers having a thickness on the order of about 0.25 to about 0.3 millimeters (5 to 6 mils) thick are issued annually for application to and display on the license plate. A recess in the license plate having a depth of about 2 to about 2.5 millimeters (80 to 100 mils), and having a post of at least similar height, will permit tamper-resistant stacking of annually issued validation stickers over the lifetime of the license plate in accordance with the present invention.

The height of the post may be somewhat less than the depth of the recess, may be about equal to the depth of the recess, or may be greater than the depth of the recess as desired. Relatively higher posts typically provide somewhat greater tamper-resistance than do relatively lower posts and are accordingly preferred in many embodiments. The relative magnitude of the height of the post and depth of the recess will be dependent in part upon the material from which the substrate is made and the manner in which it is made. Also, the sharpness of detail that the post and perimeter of the recess can have is similarly dependent. For instance, license plates are typically made of sheet metal such as aluminum and formed by stamping. The dimensions of recesses and posts for use in the invention will be limited in part by the degree of formability of the sheet metal.

Figure 5:
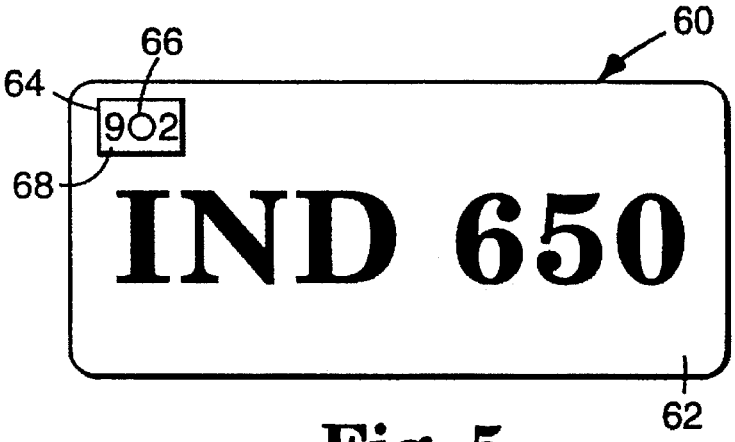
FIG. 5 is a plan view of a license plate to which a validation sticker has been applied in accordance with an embodiment of the invention.

The post may have sloping sides or shoulders as shown in FIG. 5 or may have sides that are substantially perpendicular to the plane of the floor of the recess. Similarly, the sides of the recess may be sloped from the plane of the major surface of the substrate and the floor of the recess or may be perpendicular to one or both thereof if desired. The configurations of the sides of the recess and of the post are dependent in part upon the material from which the substrate is made and the manner in which it is fabricated. Illustrative examples of materials from which substrates with recesses and posts as described herein may be formed include metals, plastics, ceramics, etc. and may be fabricated via stamping, molding, embossing, machining, etc. The posts can be formed via such general shaping techniques or via additive measures if desired, e.g., a bolt may be screwed into a recess, or a rivet applied to a recess, or a member adhered via welding or adhesive bonding to form a post in accordance with the invention.

One illustrative application of the invention is license plates. FIG. 5 shows an illustrative embodiment wherein license plate 60 with a vehicle registration number displayed on front surface 62 has been adapted in accordance with the invention. Recess 64 with post 66 has been provided, and validation sticker 68 been applied in accordance with the invention.

Figure 6:
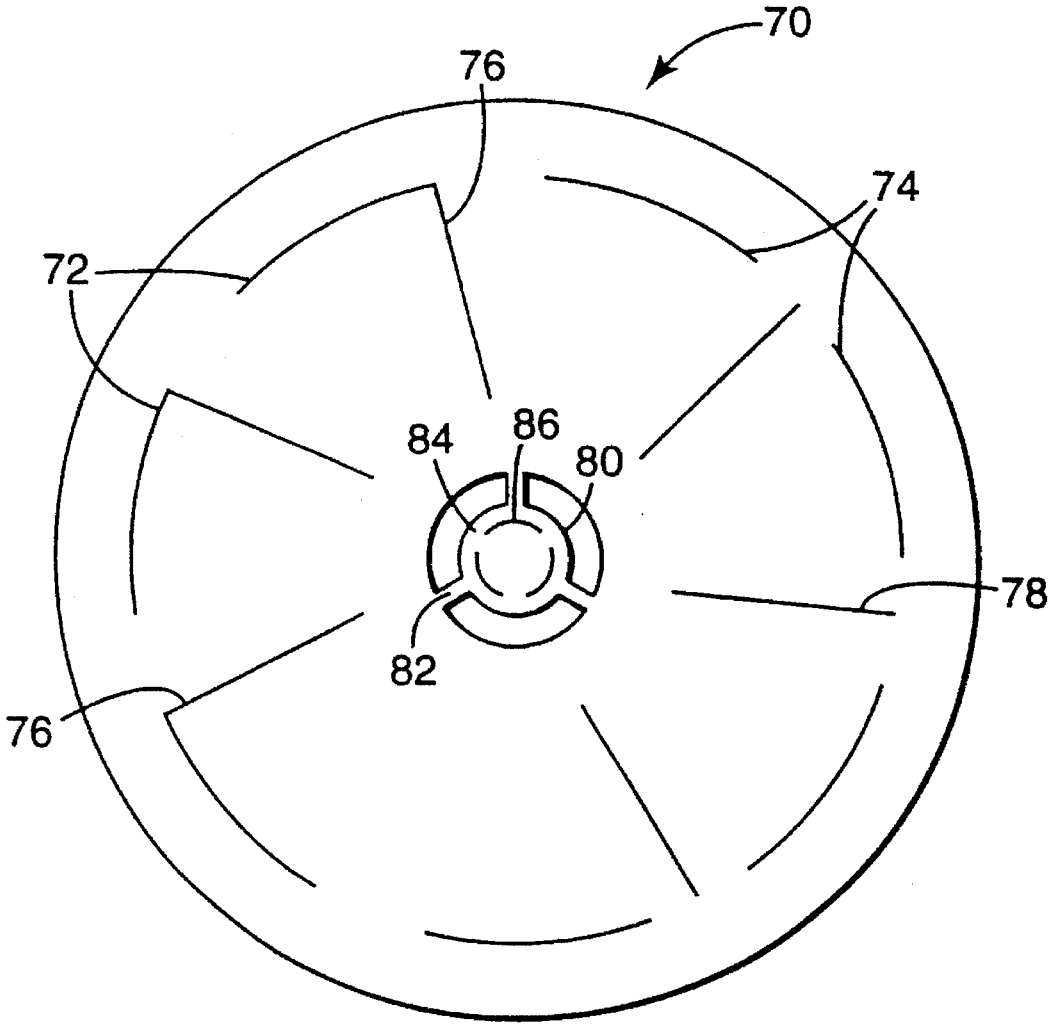
FIG. 6 is a plan view of the front of another embodiment of a validation sticker of the invention.

In a preferred embodiment, the validation sticker and recess are round in shape (i.e., a circle, oval, etc.) rather than straight (i.e., a rectangle or other polygon with few sides) as such embodiments have been found to exhibit greater removal resistance. In addition, it is preferred that the sticker contain a number of slits as discussed above. Shown in FIG. 6 is a preferred embodiment wherein circular validation sticker 70 has optional circumferential slits 72, 74, optional radial slits 76, 78, security opening 80 with optional bridges 82 to optional island 84 and optional circumferential slits 86 in island 84. Adding radial slits 76, 78 to a sticker having security opening 80 imparts greater resistance to removal. Adding circumferential slits 72, 74 imparts still greater resistance to removal. Stickers in which circumferential slits 72 intersect radial slits 76 were found to be more difficult to handle during removal from a release liner and application to a substrate and as compared to stickers wherein circumferential slits 74 do not intersect radial slits 78. Addition of island 84, preferably with bridges 82, imparts greater resistance to removal as compared to a sticker with no island. Bridges 82 facilitate handling of the sticker during removal from a release liner and application to a substrate. Addition of slits into island 84, e.g., circumferential slits 86, imparts greater resistance to removal thereto.

EXAMPLES

The invention will be further explained by the following illustrative examples which are intended to be nonlimiting.

Validation stickers of indicated configuration were applied to substrates of indicated configuration. In each example, two stickers of the indicated configuration were applied to two substrates of the indicated configuration.

In Comparative Example A and Examples 1–5 the stickers were rectangular, 25.5 by 38 millimeters (1 by 1.5 inches), and made from 3M SCOTCHLITE Brand Retroreflective Sheeting No. 4250 which comprises an alkyd sheet and acrylic pressure-sensitive adhesive.

The substrate in each instance was an aluminum license plate blank covered with a sheet of 3M SCOTCHLITE Brand Retroreflective License Plate Sheeting No. 4770, a retroreflective sheeting having a urethane top layer. In Comparative Example A and Examples 1–5, the substrate had a rectangular recess of about the same or slightly larger size as the sticker, with a depth of about 1.5 millimeter (60 mils).

The test plates were mounted in a vertical orientation about 61 centimeters (2 feet) above the floor to simulate removal from a motor vehicle. A single operator attempted to remove each sticker in the minimum amount of time, trying them in random order, using a pen knife with a 4.1 centimeter (1.63 inch) long beveled metal blade. One sticker of each configuration was attempted to be removed and then a different sticker of a different configuration was attempted to be removed.

In Comparative Example A, the substrate had recess but no post, and the stickers did not have any security openings or slits.

In Example 1 the substrates each had a recess and two round posts about 11 millimeters in diameter. The stickers each had two round security openings about 11 millimeters in diameter, centered at 12.8 millimeters from the side and closest end edges of the sticker with a separation between the pores of about 1.4 millimeters, corresponding to the posts. The islands were removed from the security openings.

In Example 2 the substrates were like those in Example 1 and the stickers were each like those in Example 1 with the addition of slits around the security openings. Two straight slits, centered on the long axis of the sticker, were cut parallel to each ends of the sticker, one 1.5 millimeters from the edge and 21 millimeters long and another 5 millimeters from the edge and 17 millimeters long. Two straight slits were cut about 7 millimeters in length, parallel to and evenly spaced between the ends of the sticker, beginning about 5 millimeters from respective sides of the sticker. Two slits were cut between each security opening and each side of the sticker, each slit being parallel to the side of the sticker, one of the slits being 15 millimeters long and 1.5 millimeters from the side of the sticker and the other slit being 12 millimeters long and 5 millimeters from the side of the sticker.

In Example 3 the substrates were like those in Example 1 and the stickers were each like those in Example 1 except the islands were left in the security openings.

In Example 4 the substrates were like those in Example 1 and the stickers were each like those in Example 3 with the addition of slits around the security openings as described in Example 2.

In Example 5 the substrates each had two square nuts secured to the front surface of the substrate with a rivet. The nuts had been machined on all four sides to protrude in to the center with an 8 millimeter radius of curvatures. The stickers each had two security openings of similar shape with inwardly protruding edges having a 9 millimeter radius.

In Comparative Example A, it took 3 to 5 minutes to remove each sticker. Each sticker was 90 to 100 percent intact.

In Example 1, it took about 5 minutes to remove each sticker. One sticker was substantially destroyed, the other was removed but underwent substantial damage.

In Example 2, it took 5 to 10 minutes to remove each sticker. One sticker was substantially destroyed, the other was removed but underwent substantial damage.

In Example 3, it took 8 to 15 minutes to remove each sticker. Both stickers were substantially destroyed.

In Example 4, it took 2 to 17 minutes to remove each sticker. Both stickers were substantially destroyed.

In Example 5, it took 4 to 9 minutes to remove each sticker. One sticker was substantially destroyed, the other was removed but underwent substantial damage.

Various modifications and alterations of this invention will become apparent to those skilled in the art without departing from the scope and spirit of this invention.

What is claimed is:

1. A license plate validation sticker mounting system for inhibiting the removal of validation stickers from license plates, comprising:

a license plate having a substantially planar surface portion, one segment of the surface portion being recessed for receiving a validation sticker, the segment having a post; and a validation sticker comprising a sheet having first and second major surfaces, said first major surface adapted for presentation of readable information, said second major surface adapted for bonding said sticker to said substrate, said sheet having an interior security opening;

said validation sticker being bonded to said license plate such that said security opening is disposed adjacent portions of said post.

2. The license plate validation sticker mounting system of claim 1, wherein:

said security opening comprises an island; and said island is affixed to portions of the post.

3. The license plate validation sticker mounting system of claim 1, wherein:

one of said security openings has an inwardly protruding border.

4. The license plate validation sticker mounting system of claim 3 wherein:

the border of at least one of said security openings is intersected by at least one slits.

5. The license plate validation sticker mounting system of claim 1 wherein:

said sheet has at least one slit that does not intersect said security opening.

6. The license plate validation sticker mounting system of claim 1 wherein:

said sheet has at least one slit that does not intersect an exterior edge of said sheet.

7. The license plate validation sticker mounting system of claim 1 wherein:

at least one of said security openings has a broadest dimension of at least 0.25 inch.

8. The license plate validation sticker mounting system of claim 1 wherein:

at least one of said security openings has a broadest dimension of at least 0.12 inch.

9. The license plate validation sticker mounting system of claim 1 wherein:

said sticker is generally round in shape.

10. The license plate validation sticker mounting system of claim 1 wherein:

said sticker is generally rectangular in shape.

11. The license plate validation sticker mounting system of claim 1 wherein:

said second major surface of said sheet is coated with adhesive.

12. The license plate validation sticker mounting system of claim 1 wherein:

readable information is displayed on said first major surface of said sheet.

13. The license plate validation sticker mounting system of claim 1 wherein:

at least a portion of said first major surface of said sticker is retroreflective.

14. The license plate validation sticker mounting system of claim 1 wherein:

said post is slightly larger than the corresponding security opening of said sticker.

15. The license plate validation sticker mounting system of claim 1 wherein:

said recessed segment is a rectangle between about 2 and 3 centimeters wide, between about 2 and about 3 centimeters long, and recessed to a depth of between about 2 and 3 millimeters.

16. The license plate validation sticker mounting system of claim 1 wherein:

at least one of said security openings contains an island.

17. The license plate validation sticker mounting system of claim 16 wherein:

said island is attached to the remainder of said sticker with at least one bridge.

18. The license plate validation sticker mounting system of claim 16 wherein:

said island has at least one slit.

* * * * *